US007724112B2

(12) United States Patent
Kerr

(10) Patent No.: US 7,724,112 B2
(45) Date of Patent: May 25, 2010

(54) SAFETY SWITCH

(75) Inventor: David Howard Kerr, Burscough (GB)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 399 days.

(21) Appl. No.: 11/744,589

(22) Filed: May 4, 2007

(65) Prior Publication Data

US 2008/0006116 A1 Jan. 10, 2008

(30) Foreign Application Priority Data

Jul. 6, 2006 (GB) ..... 0613423.3

(51) Int. Cl.
*H01H 9/20* (2006.01)
*H01H 31/00* (2006.01)

(52) U.S. Cl. ..... 335/167; 200/50.01

(58) Field of Classification Search ..... 335/167–168; 200/50.01

See application file for complete search history.

(56) References Cited

U.S. PATENT DOCUMENTS 4,280,029 A * 7/1981 Lewis ..... 200/50.01
4,659,884 A * 4/1987 Wollenhaupt ..... 200/50.01
4,713,636 A * 12/1987 Lemmer et al. ..... 335/35
RE34,396 E * 10/1993 Wollenhaupt ..... 200/50.06
5,300,905 A * 4/1994 Kolbas et al. ..... 335/167
5,300,906 A * 4/1994 Blanchard et al. ..... 335/167
6,229,421 B1 * 5/2001 Floyd et al. ..... 335/253
6,348,847 B1 * 2/2002 Nakajima et al. ..... 335/195
6,922,121 B2 * 7/2005 Kim ..... 335/167
7,132,911 B2 * 11/2006 Chung et al. ..... 335/6

* cited by examiner

*Primary Examiner*—Elvin G Enad
*Assistant Examiner*—Alexander Talpalatskiy
(74) *Attorney, Agent, or Firm*—Boyle Fredrickson LLP; William R. Walbrun; John M. Miller

(57) ABSTRACT

A safety switch that includes a locking mechanism having a rod locking element that is located adjacent to a rod and engageable with the rod to lock the rod in position relative to a housing. The safety switch locking mechanism includes a locking member that is moveable relative to the housing in response to a difference in inertia between the locking member and the housing when a force is applied to the housing. The locking member is arranged to inhibit disengagement of the rod-locking element from the rod when the force is applied to the housing.

16 Claims, 8 Drawing Sheets

SAFETY SWITCH

CROSS-REFERENCE TO RELATED APPLICATION

This application claims priority under 35 U.S.C. §119 to United Kingdom Patent Application No. 0613423.3 filed on Jul. 6, 2006, the entirety of which is incorporated by reference herein.

BACKGROUND OF THE INVENTION

The present invention relates to a safety switch.

Safety switches are well known, and are typically used to prevent access to for example electromechanical machinery when that machinery is in operation. In a conventional arrangement the safety switch is mounted on a doorpost of a machinery guard, and an actuator for the safety switch is mounted on a corresponding door. When the door is closed the actuator engages with the safety switch, which in turn closes a set of electrical contacts which allows power to be supplied to the machinery. This arrangement ensures that power can only be supplied to the machinery when the guard door is shut. When the guard door is opened, the actuator disengages from the safety switch, thereby opening the electrical contact and cutting off the supply of power to the machinery.

Some safety switches are provided with locking mechanisms which prevent the actuator from being removed from the safety switch until the locking mechanism has been deactivated. The locking mechanism can be deactivated by supplying the mechanism with an electrical signal, for example. A locking mechanism may be desirable when the machinery does not stop immediately after its power supply has been cut, or where premature interruption of the operation of the machinery could cause damage to parts of the machinery, or tools used by the machinery. A disengaging signal may not be sent to the locking mechanism until a predetermined time has passed after the power supply to the machinery has been cut-off.

It has been found that in some safety switches incorporating a locking mechanism, the locking mechanism can be temporarily disengaged by providing the safety switch with a sudden physical shock (e.g. suddenly moving or hitting the safety switch). When the locking mechanism is temporarily disengaged the actuator may be removed from the safety switch without a disengaging signal being sent to the locking mechanism. This means that a user can gain access to the machinery while it is still in motion, even though the power supply to the machinery has been cut-off, i.e. the time delayed unlocking of the locking mechanism is circumvented.

It is thus desired to overcome or substantially mitigate the above disadvantage.

BRIEF SUMMARY OF THE INVENTION

According to a first aspect of the present invention there is provided a safety switch, having a housing, a set of electrical contacts located within the housing, a rod axially moveable within the housing to open and close the set of contacts, and a locking mechanism arranged to lock the rod in position relative to the housing. The locking mechanism includes a rod-locking element that is located adjacent to the rod and engageable with the rod to lock it in position relative to the housing. A solenoid is fixed in position relative to the housing and a solenoid plunger slideably is mounted in the solenoid. The solenoid plunger is connected to the rod-locking element and is arranged such that moving the solenoid plunger relative to the solenoid actuates the rod-locking element. The safety switch further comprises a locking member that is moveable relative to the housing in response to a difference in inertia between the locking member and the housing when a force is applied to the housing. The locking member is arranged to inhibit disengagement of the rod-locking element from the rod when the force is applied to the housing.

The safety switch may further comprise a rotatable cam arrangement located within the housing. Rotation of the cam may be arranged to cause axial movement of the rod to open and close the set of contacts.

The cam arrangement may be arranged to receive and engage with an actuator. Engagement of the actuator with the cam arrangement may be arranged to rotate the cam arrangement, which causes the rod to move in an axial direction. The rod locking elements may be arranged to engage with the rod when the actuator has engaged with and rotated the cam arrangement. Engagement of the rod locking elements with the rod may be arranged to prevent rotation of the cam arrangement, and disengagement of the actuator from the cam arrangement.

BRIEF DESCRIPTION OF THE DRAWING

Embodiments of the present invention will now be described, by way of example only, with reference to the accompanying drawings, in which.

The figures are not drawn to scale, and are only schematically shown to aid the understanding of the invention and the drawings show an exemplary embodiment of the claimed invention.

DETAILED DESCRIPTION OF THE INVENTION

Figure 1A:
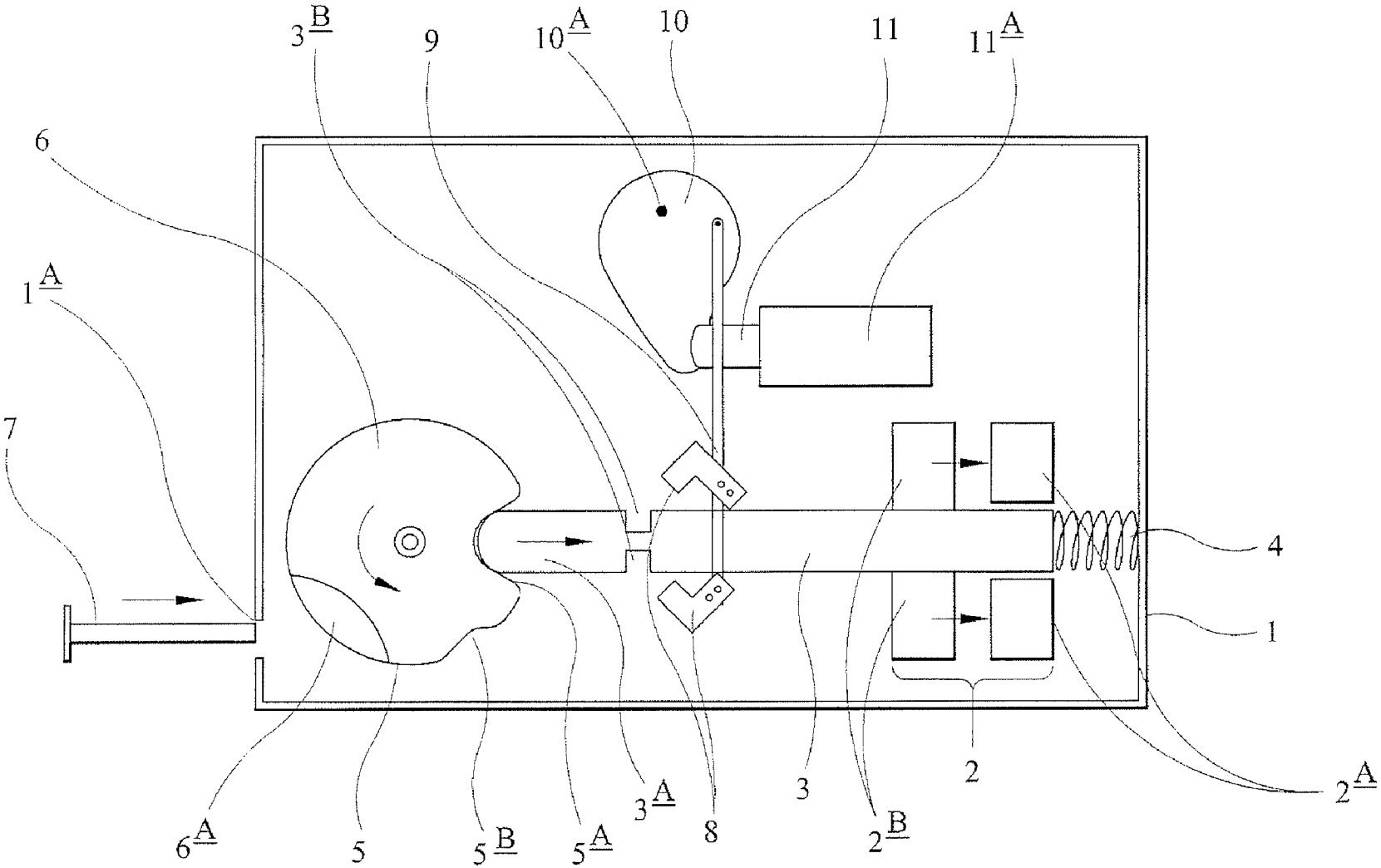
FIGS. 1A to 1E depict a safety switch assembly constructed to accommodate a locking assembly according to the present invention.

FIG. 1A is a side view of a safety switch for use with present invention. The safety switch comprises a housing 1, in which is mounted a set of contacts 2. One side 2A of the contacts 2 is fixed in position relative to the housing 1. The other side 2B of the contacts 2 is moveable relative to the housing 1, and is carried by an axially-moveable rod 3. The axially-moveable rod 3 is biased by a spring 4 which holds the sides 2A, 2B of the contacts 2 apart from one another, such that the safety switch serves to act as a break in a circuit. The safety switch may be electrically connected to electrically powered machinery such that no power can be supplied to the electrically powered machinery when the sides 2A, 2B of the contacts 2 are held apart from one another.

The axially-moveable rod 3 is moveable by a cam surface 5 of a cam arrangement 6. The cam surface 5 is moveable by rotation of the cam arrangement 6. The cam arrangement 6 is provided with a notch 6A for engaging with an actuator 7.

The cam surface 5 is provided with two indentations, a first indentation 5A and a second indentation 5B. The first indentation 5A is dimensioned such that when it is aligned with an end 3A of the axially-moveable rod 3, the axially moveable rod 3 moves into the first indentation 5A under the bias of the spring 4. When the axially moveable rod 3 moves into the first indentation 5A under the bias of the spring 4, the sides 2A, 2B of the contacts are kept apart from one another.

The safety switch is also provided with a locking mechanism. The locking mechanism is arranged to lock the axially moveable rod 3 in position in certain circumstances, to prevent the actuator 7 from being removed from the safety switch.

The locking mechanism comprises a set of rod locking members 8, which are arranged to engage with notches 3B in the axially moveable rod 3. The rod locking members 8 are connected to a movable connecting member such as a slideable locking plate 9. The locking plate 9 is in turn connected to a pivot member 10 which is arranged to pivot about a pivot point 10A. The pivot member 10 is also connected to a solenoid plunger 11 which is slideably mounted in a solenoid 11A. The solenoid 11A is fixed to the housing 1, whereas the solenoid plunger 11 may move relative to the housing 1. The solenoid plunger 11 is biased by a spring (not shown) so that it is pushed out of the solenoid 11A when the solenoid 11A is not energised. The pivot member 10 is arranged to translate 'left to right' movement (relative to the illustration of the safety switch in FIG. 1A) of the solenoid plunger 11 into 'up and down' movement (relative to the illustration of the safety switch in FIG. 1A) of the locking plate 9.

Due to the arrangement of the pivot member 10 and the elements connected to the pivot member 10, when the solenoid 11A is not activated, the biased solenoid plunger 11 attempts to rotate the pivot member 10. Since the pivot member 10 is trying to rotate, it attempts to push the locking plate 9 in the direction of the axially moveable rod 3. Such movement of the locking plate 9 causes the rod locking members 8 to try to close on the axially moveable rod 3. Since the rod locking members 8 are trying to close on the axially moveable rod 3, the rod locking members 8 are either kept in contact with the surface of the axially moveable rod 3, or kept in the notches 3B of the axially moveable rod 3 when the solenoid 11A is not energised. Use of the locking mechanism will be described in more detail below.

Figure 1B:
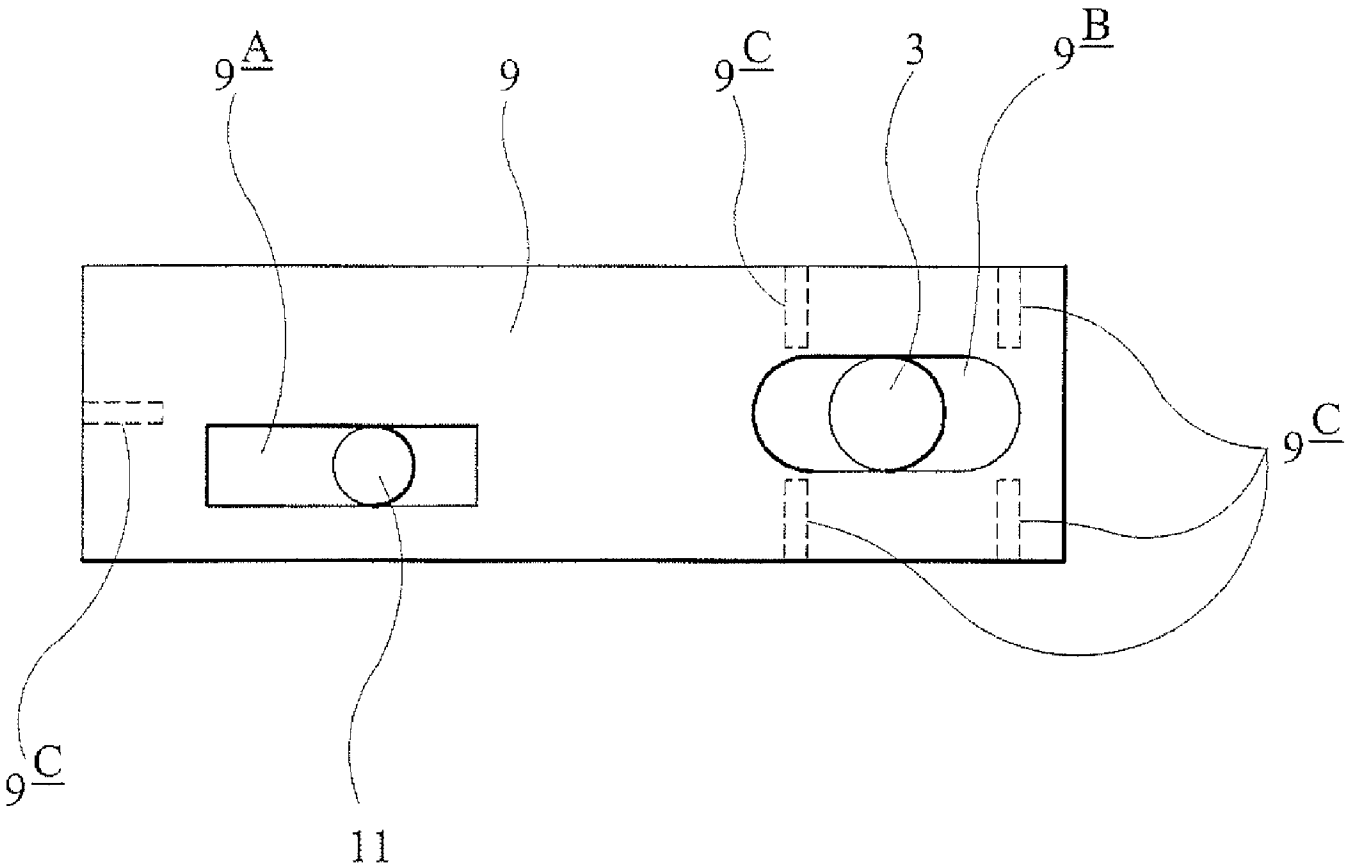

The locking plate 9 is shown in more detail in FIG. 1B. The locking plate 9 is provided with two elongate apertures 9A, 9B. A first aperture 9A allows the solenoid plunger 11 to extend through the locking plate 9. A second aperture 9B allows the axially moveable rod 3 to extend through the locking plate 9. The first and second apertures 9A, 9B are elongate so that the locking plate 9 can slide relative to the solenoid plunger 11 and axially moveable rod 3, even though the solenoid plunger 11 and axially moveable rod 3 are extending through the plate. The locking plate 9 is also provided with notches 9C for engagement with the pivot member 10 and the rod locking members 8.

It will be appreciated that other locking mechanism arrangements are possible. The present arrangement is given as an example. By employing a pivoting arrangement and a plate 9 through which elements can extend, the present locking mechanism is compact.

Figure 1C:
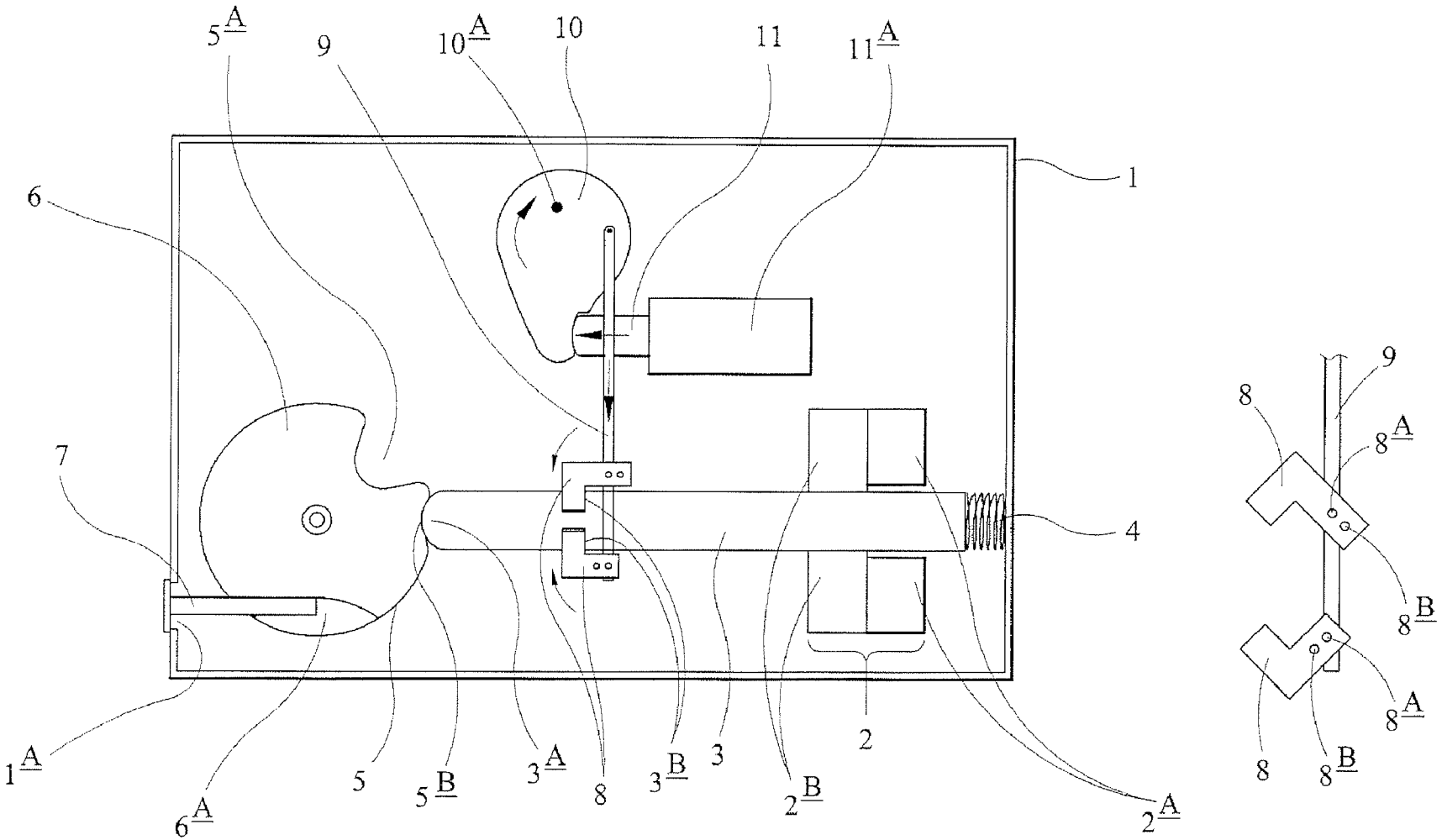

Referring to FIGS. 1A and 1C, when the actuator 7 is inserted through an aperture 1A in the casing 1, and brought into engagement with the notch 6A of the cam arrangement 6, the cam arrangement 6 and cam surface 5 rotate in an anticlockwise direction. Rotation of the cam surface 5 causes the axially moveable rod 3 to move against the bias of the spring 4, and causes the sides 2A, 2B of the contacts 2 to come into contact with one another. Further insertion of the actuator 7 causes further rotation of the cam surface 5, which in turn causes the axially moveable rod 3 to be brought into alignment with the second indentation 5B. The second indentation 5B is dimensioned such that when it is aligned with the end 3A of the axially-moveable rod 3, the axially moveable rod 3 moves into the second indentation 5B under the bias of the spring 4. Although the second indentation 5B is not as deep as the first indentation 5A, it is shaped so that the axially-moveable rod 3 prevents the cam arrangement 6 from easily rotating when the end 3A of the rod 3 is located in the indentation 5B (while still keeping the sides 2A, 2B of the contacts 2 in contact with one another). When the actuator 7 has been inserted into the housing 1, electricity may flow through the contacts 2.

As the axially moveable rod 3 is moved against the bias of the spring 4, the rod locking members 8 engage with the notches 3B of the axially moveable rod 3. The rod locking members 8 are biased to engagement by the spring (not illustrated) which acts on the solenoid plunger 11. The spring pushes the solenoid plunger 11 out of the solenoid, thereby rotating the pivot member 10 and moving the locking plate 9 towards the axially moveable rod. This causes the rod locking members 8 to rotate and engage with the notches 3B.

It will be appreciated that the connection of the rod locking members 8 to the locking plate 9 is shown schematically, and that in practice a connection which converts linear motion of the locking plate 9 to rotational motion of the locking members 8 is desired. This is shown in FIG. 1C where an enlarged view of the locking members 8 and the locking plate 9 is depicted. The locking members 9 are connected to the locking plate 9 via rotatable connectors 8A. They are also connected to the housing 1 via pivot points 8B which are positioned on opposite sides of the rotatable connectors 8A, so that movement of the locking plate 9 causes the locking members 8 to rotate in opposite directions. This allows the rod locking members 8 to engage with the notches 3B in the axially moveable rod 3.

FIG. 1C shows the safety switch with the actuator 7 fully inserted. The sides 2A, 2B of the contacts 2 are closed so that the switch can conduct electricity, and the axially moveable rod 3 has been locked in position by the rod locking members 8 of the locking mechanism.

Since the rod locking members 8 are engaged with the axially moveable rod 3, the rod 3 remains locked in position. The cam arrangement 6 cannot be rotated because the end 3A of the axially moveable rod 3 is located in the second indentation 5B of the cam surface 5. As a consequence of the cam arrangement 6 also being fixed in position, the actuator 7 cannot be disengaged from the notch 6A in the cam arrangement, and therefore the actuator 7 cannot be removed from the safety switch. In order to remove the actuator 7 from the switch, the rod locking members 8 of the locking mechanism must be disengaged from the notches 3B of the axially moveable rod 3. Disengagement of the rod locking members 8 is described with reference to FIG. 1D.

To disengage the rod locking members 8 from the notches 3B of the axially moveable rod 3, the solenoid 11A is energised. Energising the solenoid 11A causes the solenoid plunger 11 to be pulled into the solenoid 11A. When the solenoid plunger 11 is pulled into the solenoid 11A, the pivot member 10 is made to rotate, which in turn causes the locking plate 9 to move away from the axially moveable rod 3. When the locking plate 9 moves away from the axially moveable rod 3, the rod locking members 8 to which locking plate 9 is connected are made to rotate away from and therefore disengage from the notches 3B of the axially moveable rod 3. When the solenoid 11A is energised, the axially moveable rod 3 is not locked in position and is able to move axially when the cam arrangement 6 is rotated. Pulling on the actuator 7 causes the cam arrangement 6 to rotate and allows the actuator 7 to be removed from the housing 1.

When the actuator 7 is removed from the housing 1, it will cause the cam arrangement 6 and cam surface 5 to rotate in the opposite direction to that described in relation to FIG. 1A (i.e. in a clockwise direction). As the cam surface 5 rotates in the opposite direction, the sides 2A. 2B of the contacts 2 are moved apart from one another, i.e. such that the safety switch serves to act as a break in a circuit. When the actuator 7 is fully removed from the housing, the safety switch will return to the state shown in FIG. 1F (which is identical to the state shown in FIG. 1A)

The solenoid 11A may be connected to a controller which supplies power to electrically powered machinery. The controller may be configured such that it activates the solenoid 11A a predetermined time after the supply of power to the machinery has been interrupted. This allows the actuator 7 to be removed from the housing 1, thereby allowing access to the machinery.

The locking mechanism of the safety switch described in relation to FIGS. 1A to 1E offers an additional level of security, in that the switch is designed so that the actuator 7 should not be removable unless the solenoid 11A is energised. However, it has been found that, in some circumstances, it is possible to remove the actuator even when the solenoid 11A is not energised.

It has been found that in some circumstances, the actuator 7 can be removed from the safety switch by pulling on the actuator 7 whilst simultaneously subjecting the safety switch to a sudden shock (e.g. a sudden movement or impact).

Figure 1D:
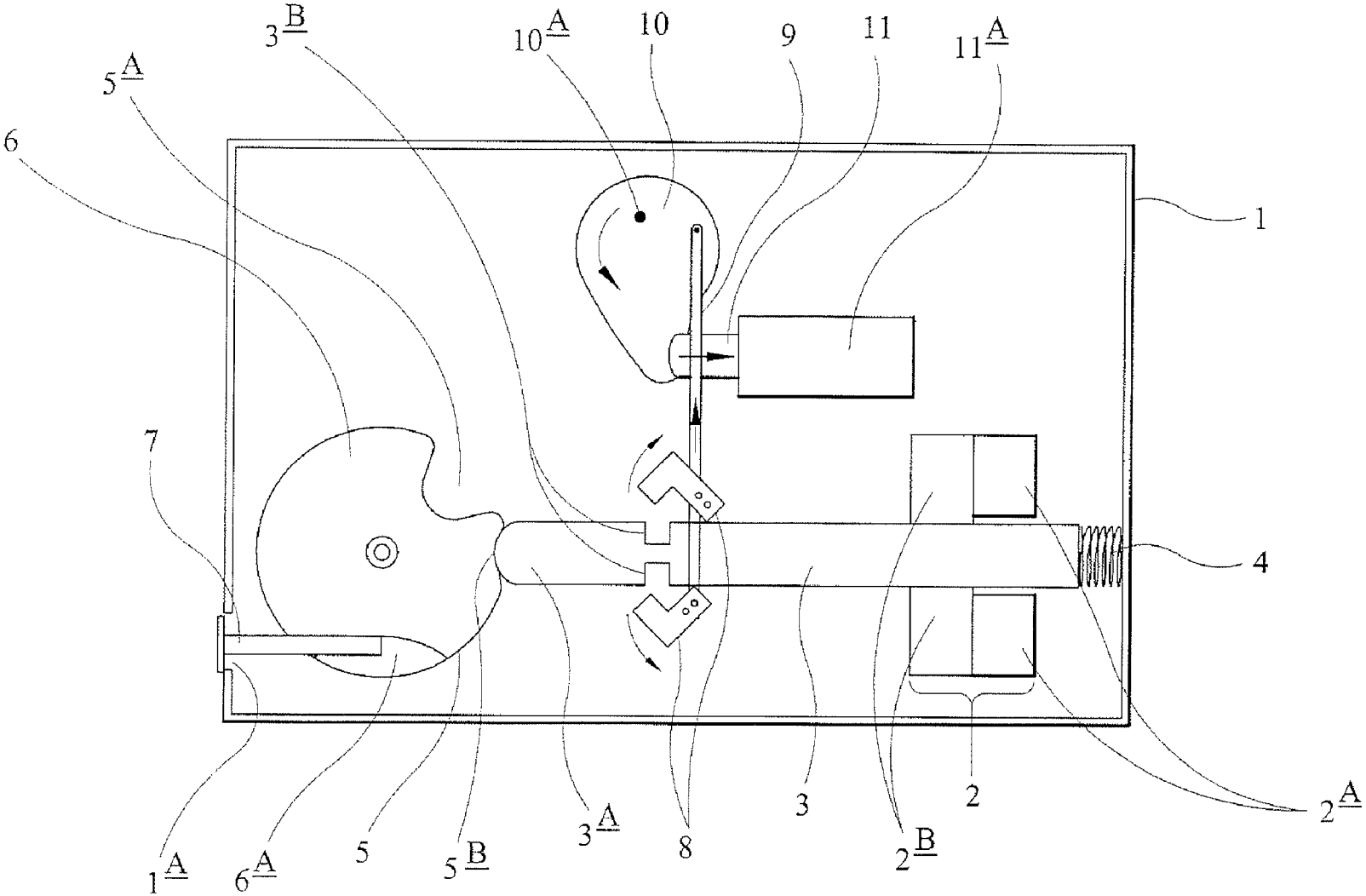
Figure 1E:
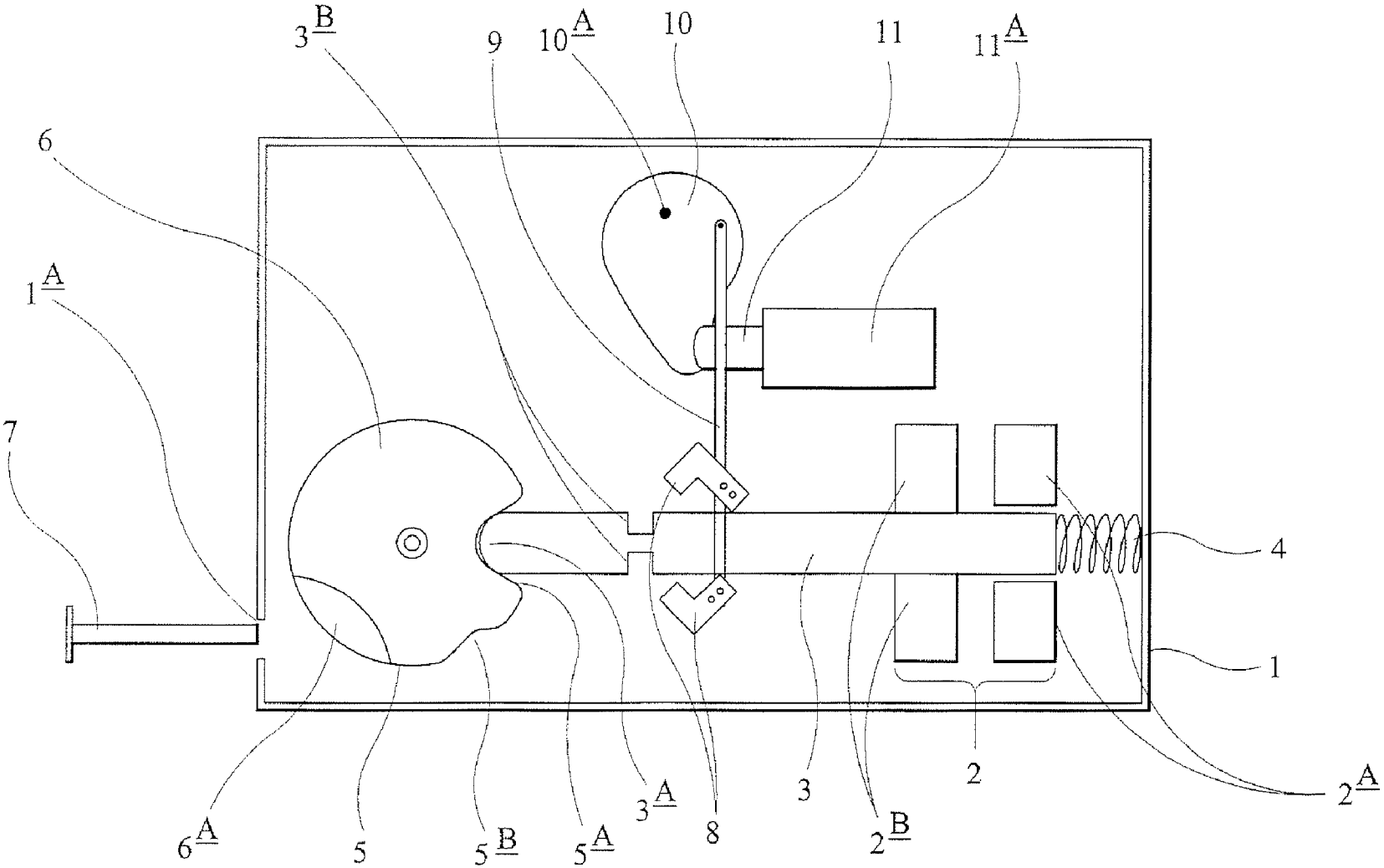

FIG. 1D shows that if the solenoid 11A is energised, the solenoid plunger 11 is drawn into the solenoid 11A which, as described above, causes the rod locking members 8 to disengage from the notches 3B of the axially moveable rod 3. FIG. 1D can also be used to explain how a sudden shock or impact to the safety switch can cause the rod locking members 8 to become disengaged from the notches 3B of the axially moveable rod 3.

As described above, the solenoid 11A is fixed to the housing 1. The solenoid plunger 11 is moveable relative to the solenoid 11A and to the housing 1. If the safety switch is subjected to a sudden impact on the right hand side of the switch (as the switch is shown in FIG. 1D), the solenoid 11A which is fixed to the housing 1 will move to the left, along with the rest of the elements fixed to the housing 1. However, since the solenoid plunger 11 is moveable relative to the solenoid 11A and therefore the housing 15 it will not move to the same extent as the solenoid 11A when the safety switch is subjected to an impact. Specifically, when the safety switch is impacted on the right hand side of the housing 1, the housing 1 will move to the left, as will the solenoid 11A. However, the solenoid plunger 11 will remain in place, since it has not been given any inertia (or, not as much as has been given to the solenoid 11A). This is because the solenoid plunger 11 is free to move with respect to the housing 1, and so is not directly affected by the impact. Since the solenoid 11A moves to the left to a greater extent than the solenoid plunger 11 the solenoid plunger 11 slides into the solenoid 11A. Because the solenoid plunger 11A slides into the solenoid 11, the pivot member 10 is rotated which in turn causes the locking plate 9 to be slid away from the axially moveable rod 3. Movement of the locking plate 9 causes the rod locking members 8 to be temporarily disengaged from the notches 3B of the axially moveable rod 3. If the actuator 7 is pulled from the housing 1 at the same time as the housing 1 is subjected to an impact as described above, the actuator can therefore be removed. FIG. 1F shows the safety switch with the actuator removed.

It has been found that if an impact occurs on any other part of the housing (i.e. other than on the right hand side of the housing 1 shown in FIG. 1D) the actuator 7 cannot be removed. This is because an impact from any direction other than the right hand side of the housing 1 does not cause the solenoid plunger 11 to move into the solenoid 11A.

It has also been found that if the safety switch 1 is properly mounted onto a support structure (e.g. a fence post) it is very difficult to impact the housing 1 with the necessary force and direction to allow the actuator 7 to be removed. However, if the safety switch is not properly mounted on a supporting structure, or if the safety switch is mounted on a supporting structure which is not rigid, it is possible to remove the actuator 7 from the safety switch, as described above. The actuator 7 can therefore be removed despite the safety switch having a locking mechanism and despite the solenoid 11A of the locking mechanism not being energised to disengage the locking elements 8. In some instances it is possible that vibration of the safety switch, for example caused by operation of the electromechanical machinery, might cause the actuator 7 to jump out of the housing 1.

Figure 2A:
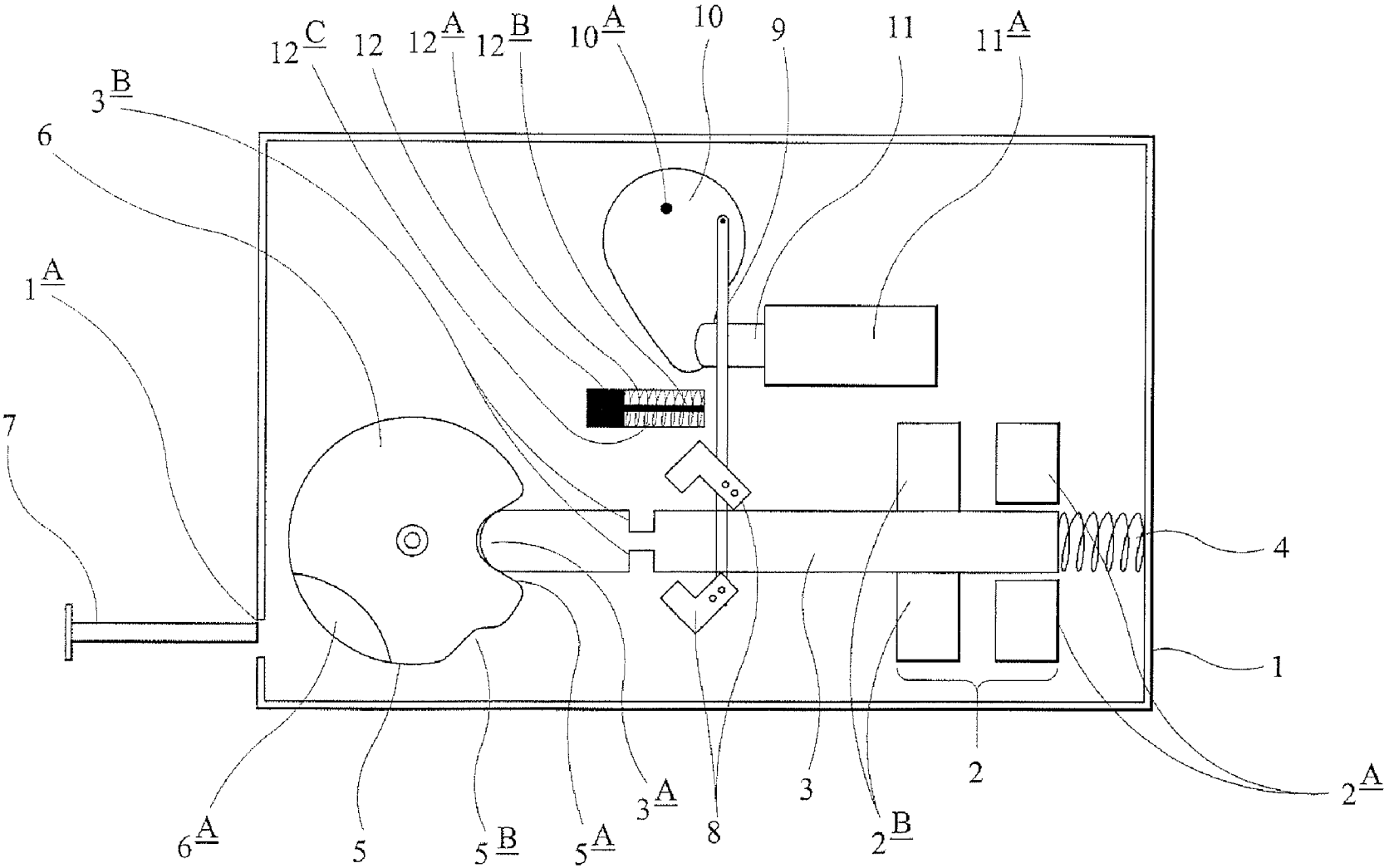
FIGS. 2A to 2C show the safety switch of FIGS. 1A-1E equipped with the locking member according to an embodiment of the present invention.
Figure 2B:
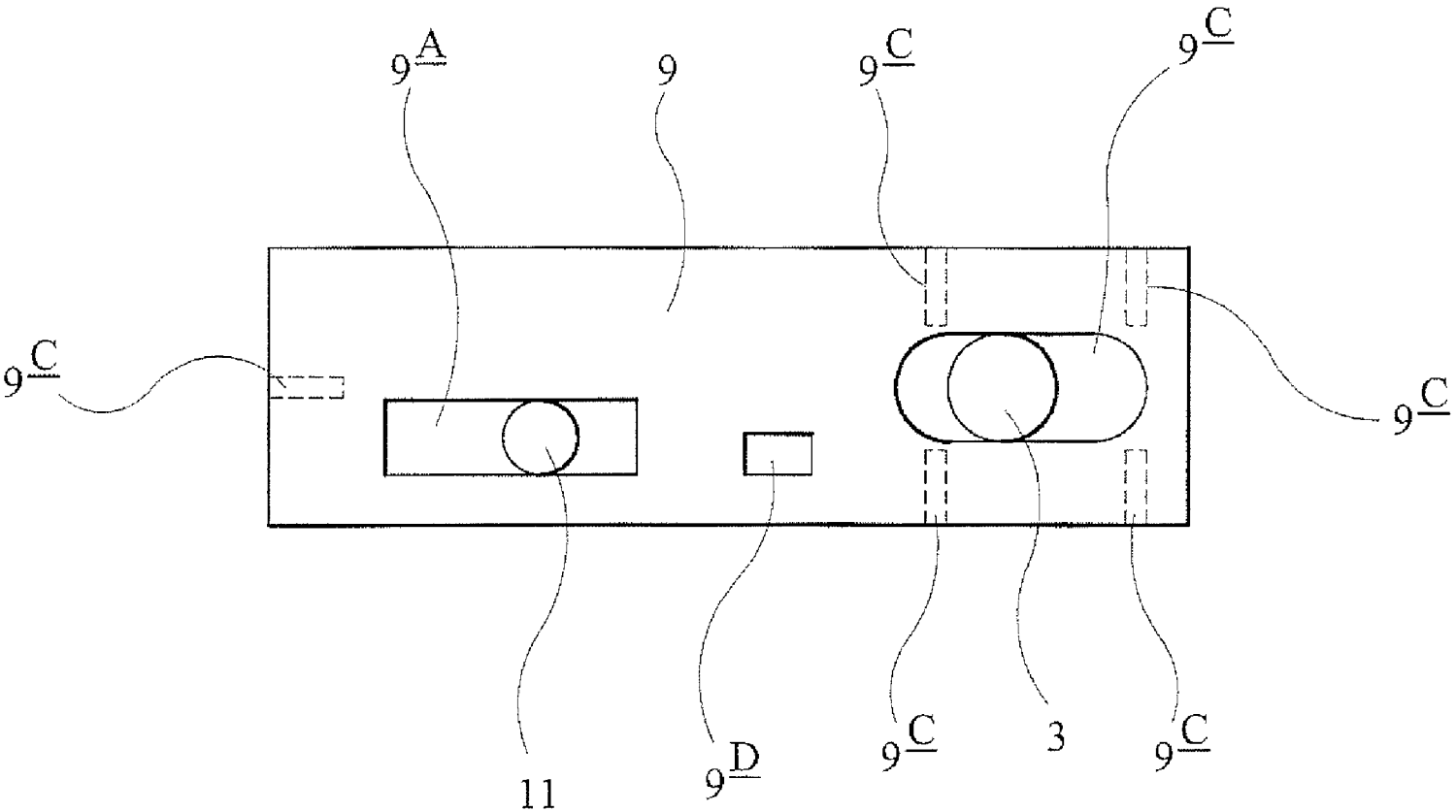

FIG. 2A illustrates a safety switch according to an embodiment of the present invention. The safety switch of FIG. 2A is similar to the safety switch of FIG. 1A. The difference between the safety switch of FIG. 1A and the safety switch of FIG. 2A is that the safety switch of FIG. 2A is provided with a plate locking member 12, and that the locking plate 9 is provided with a further aperture 9D arranged to receive a part of the plate locking member 12 (the modified locking plate is shown in FIG. 2B). The features appearing in FIGS. 1A to 1E which also appear in FIGS. 2A to 2C have been given the same reference numerals.

When the housing 1 of the safety switch is not subjected to an impact the safety switch functions in the same way as described in relation to FIGS. 1A to 1E. It is only when the safety switch of FIGS. 2A to 2C is subjected to a particular directional impact that differences in the operation between the safety switch of FIGS. 1 and 2 become apparent.

Referring to FIG. 2A, the plate-locking member 12 is provided to prevent the rod locking members 8 becoming disengaged when the safety switch is subjected to an impact. The plate-locking member 12 comprises a housing 12A, a locking pin 12B and a spring 12C. The spring 12C biases the locking pin 12A so that the locking pin 12B is pushed to one end of the housing 12A, away from the locking plate 9. The locking pin 12B is slideable within the housing, and against the bias of the spring 12C.

Figure 2C:
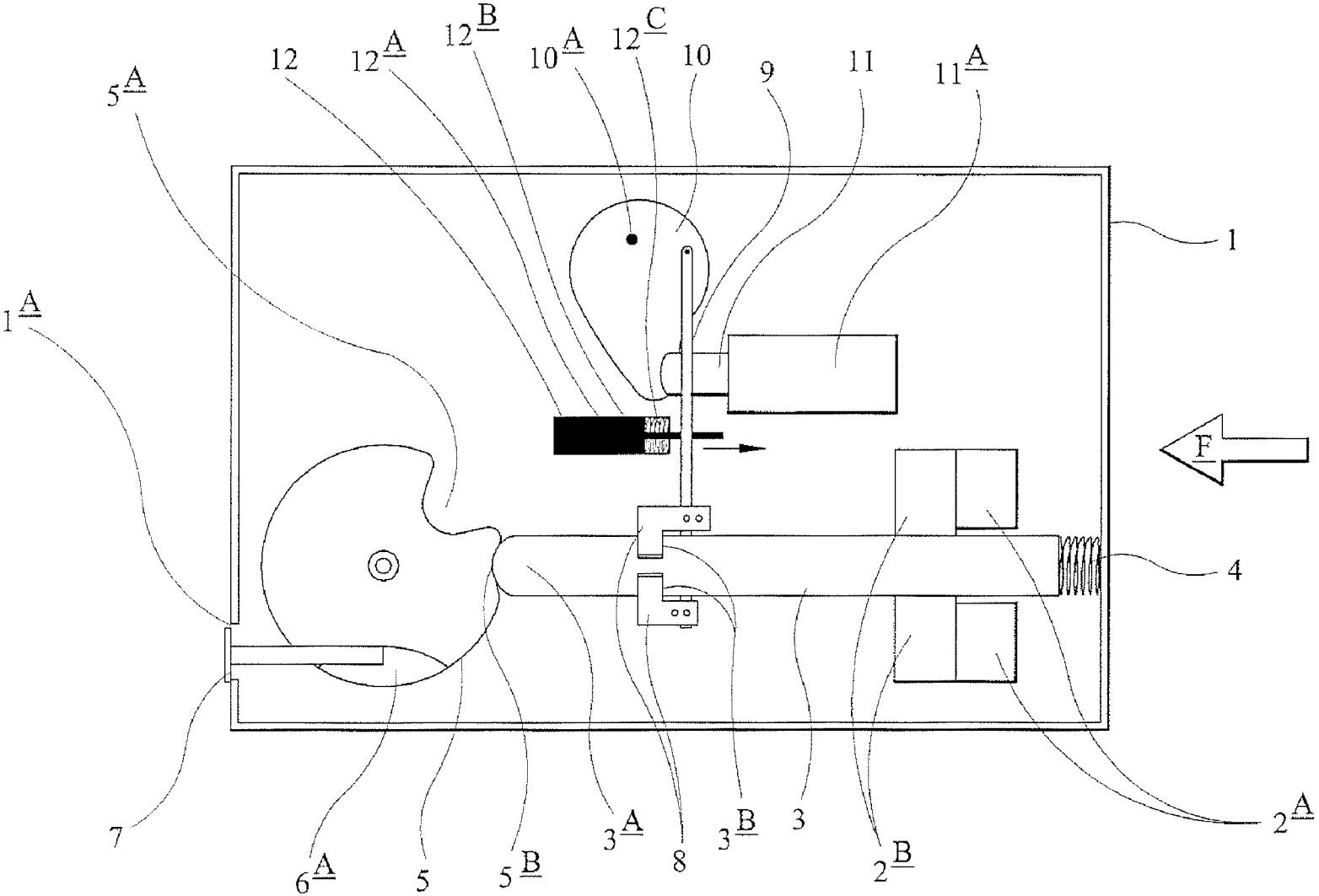

FIG. 2C illustrates the operation of the plate-locking member 12. FIG. 2C shows the safety switch when the rod locking members 8 of the locking mechanism are engaged with the notches 3B of the axially moveable rod 3.

When the housing 1 is subjected to an impact force F (indicated by the arrow on the right hand side of the housing 1 in FIG. 2C) the solenoid 11A will move to the left along with the housing 1. Simultaneously, the solenoid plunger 11 will attempt to move into the solenoid 11A due to inertia of the solenoid plunger 11 with respect to the solenoid 11A. This effect is described in more detail above.

When the housing 1 is subjected to an impact force F from the right hand side, the locking pin 12B of the locking member 12 slides toward the locking plate 9, and then through the aperture 9D provided in the locking plate 9 (shown in FIG. 2B). This is because the locking pin 12B is free to move with respect to the housing 1, and so is not directly affected by the impact. When the locking pin 12B extends through the aperture 9D in the locking plate 9, the locking plate 9 is unable to slide. Because the locking plate 9 is unable to slide, the rod locking members 8 cannot be disengaged from the notches 3B of the axially moveable rod 3.

Since the rod locking members 8 cannot be disengaged from the axially moveable rod 3, the rod 3 remains locked in position. The cam arrangement 6 cannot be rotated because the end 3A of the axially moveable rod 3 is located in the second indentation 5B of the cam surface 5. As a consequence of the cam arrangement 6 also being fixed in position, the actuator 7 cannot be disengaged from the notch 6A in the cam arrangement, and therefore the actuator 7 cannot be removed from the safety switch.

When the force F is no longer applied to the right hand side of the safety switch (i.e. after the impact), the spring 12C of the plate locking member 12 biases the locking pin 12B back into the housing 12A. The locking pin 12B is thereby withdrawn from the aperture 9D in the locking plate 9. The locking plate 9 is therefore able to move if the solenoid 11A is subsequently energised. This allows the switch to operate in the same manner as described with reference to FIGS. 1A to 1E.

In the embodiments described above, the force F is stated as being applied to the right hand side of the safety switch. It will be appreciated that an applied force need only have a component which is applied to the right hand side of the housing, i.e. the force may have other components not acting on or in the direction of the right hand side of the housing. It will be appreciated that the force and direction of the force necessary to move the solenoid plunger will depend on the location and orientation of the solenoid plunger, and that the force and its direction may be different for different safety switches.

The locking pin 12B may extend through an aperture to lock the locking plate into position. Alternatively, the locking pin 12B may extend into the aperture (i.e. not necessarily through the aperture) to lock the locking plate into position.

The weight of the locking pin 12B should be appropriately chosen so that during an impact the locking pin 12B extends through the aperture 9D of the locking plate 9, earlier or at generally the same time that the solenoid plunger 11 is biased to move into the solenoid 11A. If this were not the case it is possible that movement of the solenoid plunger 11 into the solenoid 11A, could cause the locking plate 9 to slide before the locking pin 12B of the plate locking member 12 has passed through the aperture 9D of the locking plate 9 and locked it in position. This would allow the actuator 7 to be removed from the housing 1 during the impact. The weight of the locking pin 12B may for example be substantially equal to the weight of the solenoid plunger 11, or even greater than the weight of the solenoid plunger 11. The biasing force provided by the spring 12C may be appropriately chosen for a locking pin 12B of a certain weight, in order to ensure that the locking pin 12B locks the locking plate in position during an impact to the safety switch.

The solenoid plunger is described as being connected to the rod-locking element. It will be appreciated that the solenoid plunger may be directly connected to the rod-locking element, or that the solenoid plunger may be indirectly connected to the rod-locking element. For example, the solenoid plunger may be indirectly connected to the rod-locking element through several intermediate (or linked) components.

The safety switch could operate in any suitable manner, as is known in the art. For example, the logic of the safety switch contacts 2 could be reversed such that the sides 2A, 2B of the contacts 2 are brought into contact with each other when the end 3A of the axially moveable rod 3 is received in the first indentation 5A of the cam surface 5 (instead of the second indentation 5B). The rod locking members 8 would then lock the rod 3 in this position.

The locking plate described above could be a locking bar, or any suitable connecting member. The notches in the axially moveable rod and the rod rocking members can be of any suitable configuration, so long as the rod locking members can lock the rod in position.

It will be appreciated that the present invention could be applied to any safety switch employing the same or similar locking mechanism described above, and that the invention is only limited by the claims and the equivalents thereof, which follow.

What is claimed is:

1. A safety switch, comprising:

a housing;

a set of electrical contacts located within the housing;

a rod, axially moveable within the housing to open and close the set of contacts;

a locking mechanism arranged to lock the rod in position relative to the housing, the locking mechanism comprising a rod locking element located adjacent to the rod and engageable with the rod to lock it in position relative to the housing;

a solenoid fixed in position relative to the housing;

a solenoid plunger slideably mounted in the solenoid, the solenoid plunger being connected to the rod locking element, and being arranged such that moving the solenoid plunger relative to the solenoid actuates the rod locking element;

the solenoid plunger being moveable in a first direction and the locking mechanism, being moveable in a second direction that is substantially perpendicular to the first direction;

the solenoid plunger being connected to a moveable connecting member by a pivot member pivotable about a pivot point fixed in position relative to the housing, the pivot member being arranged to translate movement of the solenoid plunger in the first direction to movement of the connecting member in the second direction; and a locking member that is moveable relative to the housing in response to a difference in inertia between the locking member and the housing when a force is applied to the housing, the locking member being arranged to inhibit disengagement of the rod locking element from the rod when the force is applied to the housing.

2. The safety switch as claimed in claim 1, wherein the moveable connecting member mechanically connects the solenoid plunger to the rod-locking element.

3. The safety switch as claimed in claim 2, wherein the moveable connecting member is provided with an aperture configured to receive the locking member.

4. The safety switch as claimed in claim 3, wherein the locking member is moveable between a first position where the locking member is not received by the aperture of the connecting member, and a second position where the locking member is received by the aperture of the connecting member.

5. The safety switch as claimed in claim 4, wherein the locking member is biased towards the first position.

6. The safety switch as claimed in claim 3 wherein the moveable connecting member is fixed in position relative to the housing when the locking member has been received by the aperture, thereby inhibiting disengagement of the rod locking element from the rod.

7. The safety switch as claimed in claim 2, wherein the moveable connecting member is a plate.

8. The safety switch as claimed in claim 1, further comprising a rotatable cam arrangement located within the housing, rotation of the cam being arranged to cause axial movement of the rod to open and close the set of electrical contacts.

9. The safety switch as claimed in claim 8, wherein the rotatable cam arrangement is arranged to receive an actuator which rotates the cam, the locking mechanism being arranged to lock the rod in position once the actuator has engaged with and rotated the cam arrangement, thereby preventing rotation of the cam arrangement, and disengagement of the actuator from the cam arrangement.

10. The safety switch as claimed in claim 1, wherein the solenoid is configured such that energising the solenoid causes the rod-locking element to disengage from the rod.

11. The safety switch as claimed in claim 1, wherein the rod-locking element is one of two or more rod locking elements.

12. The safety switch as claimed in claim 1, wherein the locking member has a weight that is generally equal to a weight of the solenoid plunger.

13. A safety switch assembly comprising: a housing; a solenoid having a plunger that is slideably mounted in the solenoid and disposed within the housing; a movable rod disposed within the housing and oriented in a generally parallel alignment with the plunger; a rotatable cam arrangement located within the housing and oriented so that rotation of a cam causes axial movement of the rod to open and close a set of electrical contacts; an actuator that removably cooperates with the safety switch housing to rotate the cam; a first locking member moveably disposed between the plunger and the moveable rod and operatively connected therebetween so that movement of the plunger actuates the first locking member, the first locking member being arranged to lock the rod in position once the actuator has engaged with the cam arrangement, and prevent rotation of the cam arrangement, and prevent disengagement of the actuator from the cam arrangement; and a second locking member that is moveably supported relative to the housing so that a difference in inertia between the second locking member and the housing is generated when the housing is subjected to an impact force, the second locking member being configured to engage the first locking member to prevent movement of the first locking member when the housing is subjected to the impact force.

14. The safety switch assembly of claim 13 further comprising a spring connected between the second locking member and the housing.

15. The safety switch assembly of claim 13 further comprising an opening formed in the first locking member constructed to receive a portion of the second member.

16. The safety switch assembly of claim 13 wherein a portion of the second locking member is constructed to selectively interfere with the first locking member such that the first locking member cannot move with respect to the housing when the second locking member is interfering therewith.

* * * * *